US008743027B2

(12) United States Patent
Wu et al.

(10) Patent No.: US 8,743,027 B2
(45) Date of Patent: Jun. 3, 2014

(54) OLED DRIVING CIRCUIT AND METHOD OF THE SAME USED IN DISPLAY PANEL

(75) Inventors: Chi-Liang Wu, Hsinchu (TW); Po-Hsin Lin, Hsinchu (TW); Chin-Wen Lin, Hsinchu (TW); Ted-Hong Shinn, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 147 days.

(21) Appl. No.: 13/558,313

(22) Filed: Jul. 25, 2012

(65) Prior Publication Data

US 2013/0050175 A1 Feb. 28, 2013

Related U.S. Application Data

(60) Provisional application No. 61/528,767, filed on Aug. 30, 2011.

(30) Foreign Application Priority Data

Feb. 8, 2012 (TW) ..... 101104095 A

(51) Int. Cl.
*G09G 3/30* (2006.01)

(52) U.S. Cl.
USPC ..... 345/76; 345/82; 345/92; 315/169.1; 315/169.2; 315/169.3; 315/169.4

(58) Field of Classification Search
USPC ..... 345/74, 82, 92; 315/169.1–169.4
See application file for complete search history.

(56) References Cited

U.S. PATENT DOCUMENTS

| | | | | |
|---|---|---|---|---|
| 7,138,967 | B2 * | 11/2006 | Kimura | 345/76 |
| 7,800,556 | B2 | 9/2010 | Chen et al. | |
| 8,558,767 | B2 * | 10/2013 | Kwon | 345/77 |
| 2005/0225251 | A1 | 10/2005 | Hsueh | |
| 2011/0050659 | A1 | 3/2011 | Tsai et al. | |

* cited by examiner

*Primary Examiner* — William Boddie
*Assistant Examiner* — Sahlu Okebato
(74) *Attorney, Agent, or Firm* — CKC & Partners Co., Ltd.

(57) ABSTRACT

An OLED driving circuit is provided. The OLED driving circuit comprises a switch transistor, a storage capacitor, a driving transistor and a control module. In a charging time period, a charging switch of the control module is conducted to connect the storage capacitor and a first voltage end and a data signal is transmitted from the switch transistor to the storage capacitor. In a memory time period, a memory switch of the control module is conducted to connect the storage capacitor and an OLED and the data signal is transmitted from the switch transistor to the storage capacitor. In a light-emitting time period, three light-emitting switches are conducted to connect the driving transistor to the storage capacitor, the first voltage end and the OLED.

18 Claims, 5 Drawing Sheets

OLED DRIVING CIRCUIT AND METHOD OF THE SAME USED IN DISPLAY PANEL

RELATED APPLICATIONS

This application claims priority to U.S. Provisional Application Ser. No. 61/528,767 filed Aug. 30, 2011, and Taiwan Application Serial Number 101104095, filed Feb. 8, 2012, the disclosures of which are incorporated herein by reference in their entireties.

BACKGROUND

1. Technical Field

The present invention relates to display technology. More particularly, the present invention relates to an OLED driving circuit and an OLED driving method used in a display panel.

2. Description of Related Art

An organic light-emitting diode (OLED) is a light-emitting diode (LED) in which the emissive electro-luminescent layer is a film of organic compounds that emits light in response to an electric current. This technology promises thin, light weight emissive display with low voltage, low power consumption, high contrast, wide viewing angle and fast switching time. A layer of organic semiconductor material is situated between two electrodes such that least one of these electrodes is transparent. Thus these materials are considered as organic semiconductors. An OLED enables us to produce flexible displays. Use of flexible substrates could open the door to new applications such as roll-up displays and displays embedded in fabrics or clothing. OLED scan enable a greater artificial contrast ratio and viewing angle compared to LCDs because OLED pixels directly emit light. OLEDs can also have a faster response time than standard LCD screens. An OLED display functions without a backlight, therefore it can display deep black levels and can be thinner and lighter than established LCDs. OLED has high affinity towards plastic substrates. Hence, OLED display technology is gaining dominance in the modern electronic era.

However, material degradation of the OLED generated under long-term operation causes the deviation of the threshold voltage of the OLED. The deviation of the threshold voltage may result in the decrease of the brightness of the OLED when there is no compensation mechanism of the driving method.

Accordingly, what is needed is an OLED driving circuit and an OLED driving method used in a display panel to compensate the threshold voltage degradation.

SUMMARY

An aspect of the present disclosure is to provide an OLED (organic light emitting diode) driving circuit to drive an OLED. The OLED driving circuit comprises a switch transistor, a storage capacitor, a driving transistor and a control module. The switch transistor comprises a first source/drain terminal to receive a data signal, a second source/drain terminal and a gate terminal to receive a scan signal. The storage capacitor comprises a first end and a second end. The driving transistor comprises a first source/drain terminal, a gate terminal and a second source/drain terminal connected to the OLED. The control module comprises a charging switch, a memory switch and three light-emitting switches. The charging switch is connected between the first end of the storage capacitor and a first voltage end. The memory switch is connected between the first end of the storage capacitor and the second source/drain terminal of the driving transistor. The three light-emitting switches are respectively connected between the first end of the storage capacitor and the gate terminal of the driving transistor, between the first voltage end and the first source/drain terminal of the driving transistor and between the second end of the storage capacitor and the second source/drain terminal of the driving transistor. In a charging time period, the charging switch is controlled to be conducted and the three light-emitting switches and the memory switch are controlled to be un-conducted such that the scan signal turns on the switch transistor to transmit the data signal from the first source/drain terminal of the switch transistor to the second source/drain terminal of the switch transistor. In a memory time period after the charging time period, the memory switch is controlled to be conducted and the three light-emitting switches and the charging switch are controlled to be un-conducted such that the scan signal turns on the switch transistor to transmit the data signal from the first source/drain terminal of the switch transistor to the second source/drain terminal of the switch transistor. In a light-emitting time period after the memory time period, the three light-emitting switches are controlled to be conducted and the memory switch and the charging switch is controlled to be un-conducted such that the scan signal turns off the switch transistor.

Another aspect of the present disclosure is to provide a display panel. The display panel comprises a data driving module, a gate driving module and a pixel array. The data driving module comprises a plurality of data lines. The gate driving module comprises a plurality of scan lines. The pixel array comprises a plurality of pixel units each comprising an OLED and an OLED driving circuit. The OLED driving circuit comprises a switch transistor, a storage capacitor, a driving transistor and a control module. The switch transistor comprises a first source/drain terminal to receive a data signal from one of the data lines, a second source/drain terminal and a gate terminal to receive a scan signal from one of the scan lines. The storage capacitor comprises a first end and a second end. The driving transistor comprises a first source/drain terminal, a gate terminal and a second source/drain terminal connected to the OLED. The control module comprises a charging switch, a memory switch and three light-emitting switches. The charging switch is connected between the first end of the storage capacitor and a first voltage end. The memory switch is connected between the first end of the storage capacitor and the second source/drain terminal of the driving transistor. The three light-emitting switches are respectively connected between the first end of the storage capacitor and the gate terminal, between the first voltage end and the first source/drain terminal of the driving transistor and between the second end of the storage capacitor and the second source/drain terminal of the driving transistor. In a charging time period, the charging switch is controlled to be conducted and the three light-emitting switches and the memory switch are controlled to be un-conducted such that the scan signal turns on the switch transistor to transmit the data signal from the first source/drain terminal of the switch transistor to the second source/drain terminal of the switch transistor. In a memory time period after the charging time period, the memory switch is controlled to be conducted and the three light-emitting switches and the charging switch are controlled to be un-conducted such that the scan signal turns on the switch transistor to transmit the data signal from the first source/drain terminal to the second source/drain terminal. In a light-emitting time period after the memory time period, the three light-emitting switches are controlled to be conducted and the memory switch and the charging switch is controlled to be un-conducted such that the scan signal turns off the switch transistor.

Yet another aspect of the present disclosure is to provide an OLED driving method to drive an OLED. The OLED driving method comprises the steps outlined below. An OLED driving circuit comprising a switch transistor, a driving transistor, a storage capacitor, and a control module is provided, wherein the storage capacitor is connected to the switch transistor and a second source/drain terminal of the driving transistor is connected to the OLED. The switch transistor is turned on during a charging time period to receive a data signal and transmit the data signal to the storage capacitor and the storage capacitor is controlled by the control module such that the storage capacitor is connected to a first voltage end. The switch transistor is turned on during a memory time period after the charging time period to receive the data signal and transmit the data signal to the storage capacitor and the storage capacitor is controlled by the control module such that the storage capacitor is connected to the OLED. The switch transistor is turned off during a light-emitting time period after the memory time period, the storage capacitor is controlled by the control module such that the storage capacitor is connected to a gate terminal of the driving transistor and the second source/drain terminal and a first source/drain terminal of the driving transistor is controlled to be connected to the first voltage end.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
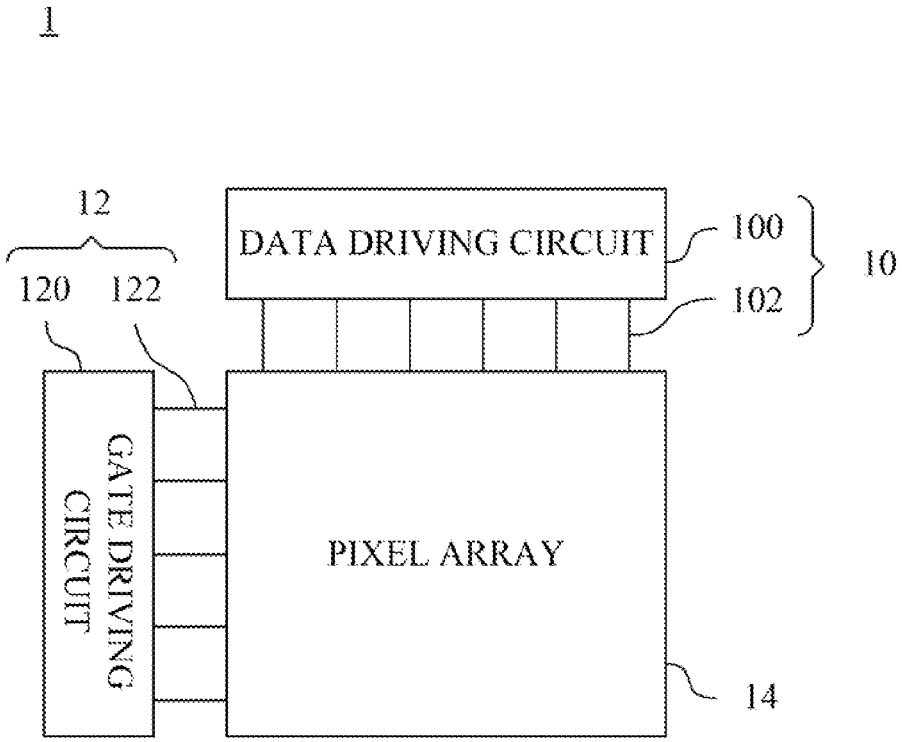
FIG. 1 is a block diagram of a display panel in an embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

Figure 2:
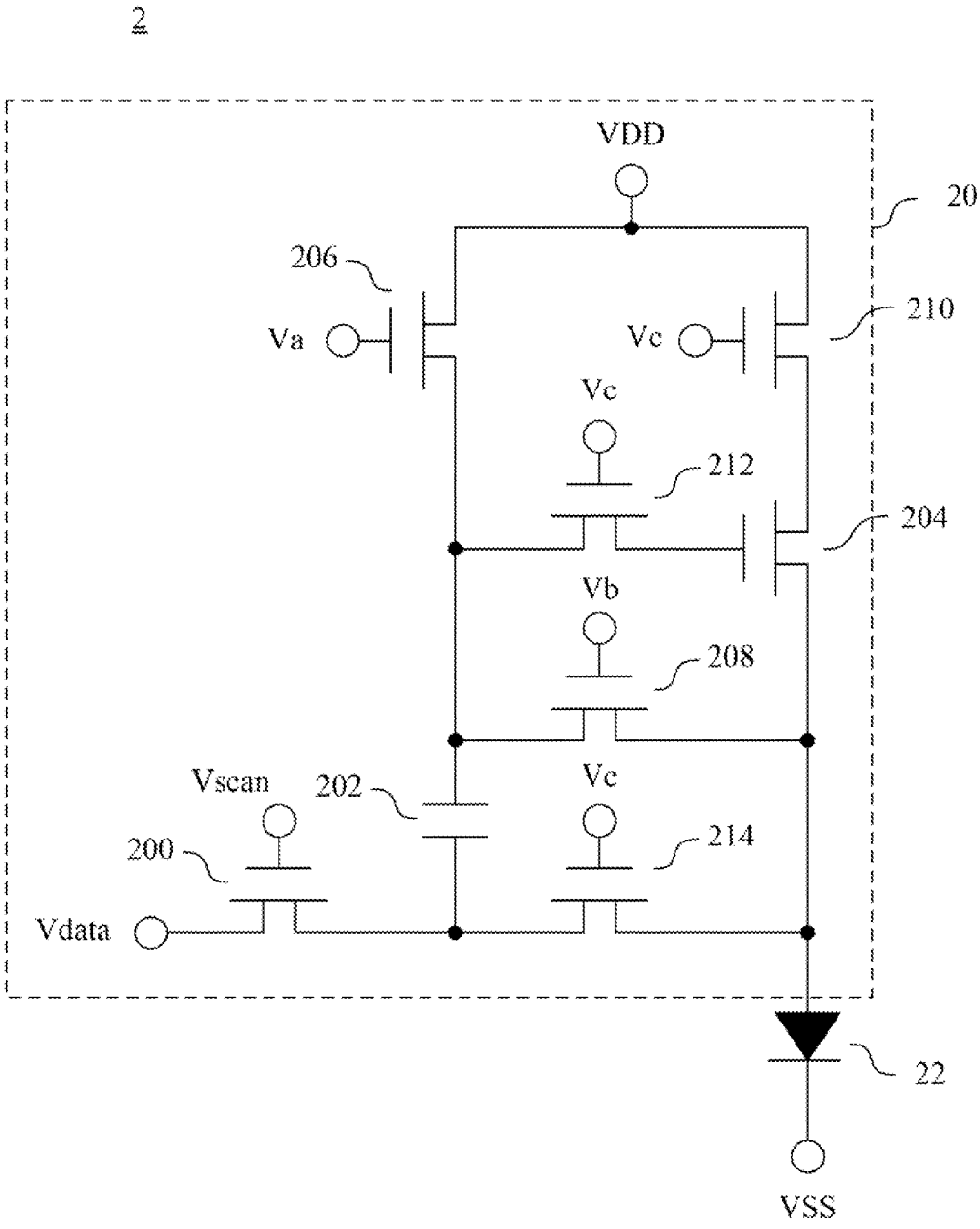
FIG. 2 is a circuit diagram of a pixel unit in an embodiment of the present disclosure.

FIG. 1 is a block diagram of a display panel 1 in an embodiment of the present disclosure. FIG. 2 is a circuit diagram of a pixel unit 2 in an embodiment of the present disclosure.

The display panel 1 comprises a data driving module 10, a gate driving module 12 and a pixel array 14. The data driving module 10 comprises a data driving circuit 100 and a plurality of data lines 102. The gate driving module 12 comprises a gate driving circuit 120 and a plurality of scan lines 122. The pixel array 14 comprises a plurality of pixel units 2 as shown in FIG. 2.

Each of the pixel units 2 comprises an OLED driving circuit 20 and an OLED 22. The OLED driving circuit 20 comprises a switch transistor 200, a storage capacitor 202, a driving transistor 204 and a control module.

The switch transistor 200 comprises a first source/drain terminal to receive a data signal Vdata, a second source/drain terminal and a gate terminal to receive a scan signal Vscan. In an embodiment, the first source/drain terminal is connected to one of the data lines 102 depicted in FIG. 1. The data signal Vdata is generated from the data driving circuit 100 and is transmitted to the first source/drain terminal through the corresponding data line 102. The gate terminal is connected to one of the scan lines 122 depicted in FIG. 1. The scan signal Vscan is generated from the gate driving circuit 120 and is transmitted to the gate terminal through the corresponding scan line 122. In an embodiment, the data driving circuit 100 and the gate driving circuit 120 generates the appropriate data signal Vdata and the scan signal Vscan in accordance to a timing control module (not shown).

The storage capacitor 202 comprises a first end and a second end. The second end of the storage capacitor 202 is connected to the second source/drain terminal of the switch transistor 200. The driving transistor 204 comprises a first source/drain terminal, a gate terminal and a second source/drain terminal connected to the OLED 22.

In an embodiment, the switch transistor 200 and the driving transistor 204 described above is fabricated by a thin-film transistor fabrication process.

The control module comprises a charging switch 206, a memory switch 208 and three light-emitting switches 210, 212 and 214. The charging switch 206 is connected between the first end of the storage capacitor 202 and a first voltage end VDD. The memory switch 208 is connected between the first end of the storage capacitor 202 and the second source/drain terminal of the driving transistor 204. The light-emitting switch 210 is connected between the first voltage end VDD and the first source/drain terminal of the driving transistor 204. The light-emitting switch 212 is connected between the first end of the storage capacitor 202 and the gate terminal of the driving transistor 204. The light-emitting switch 214 is connected between the second end of the storage capacitor 202 and the second source/drain terminal of the driving transistor 204.

In an embodiment, each of the charging switch 206, the memory switch 208 and the three light-emitting switches 210, 212 and 214 is a transistor. In an embodiment, the charging switch 206, the memory switch 208 and the three light-emitting switches 210, 212 and 214 can be fabricated by a thin-film transistor fabrication process similar to the switch transistor 200 and the driving transistor 204.

In an embodiment, the gate of the charging switch 206 receives a charging switch control signal Va such that the charging switch 206 is controlled to be conducted or un-conducted according to the charging switch control signal Va. The gate of the memory switch 208 receives a memory switch control signal Vb such that the memory switch 208 is controlled to be conducted or un-conducted according to the memory switch control signal Vb. Each of the gates of the three light-emitting switches receives a light-emitting switch control signal Vc such that the three light-emitting switches are controlled to be conducted or un-conducted according to the light-emitting switch control signal Vc.

An anode of the OLED 204 is connected to the second source/drain terminal of the driving transistor 204 and a cathode of the OLED 204 is connected to a second voltage end VSS. In an embodiment, a second voltage level of the second voltage end VSS is smaller than a first voltage level of the first voltage end VDD.

Figure 3:
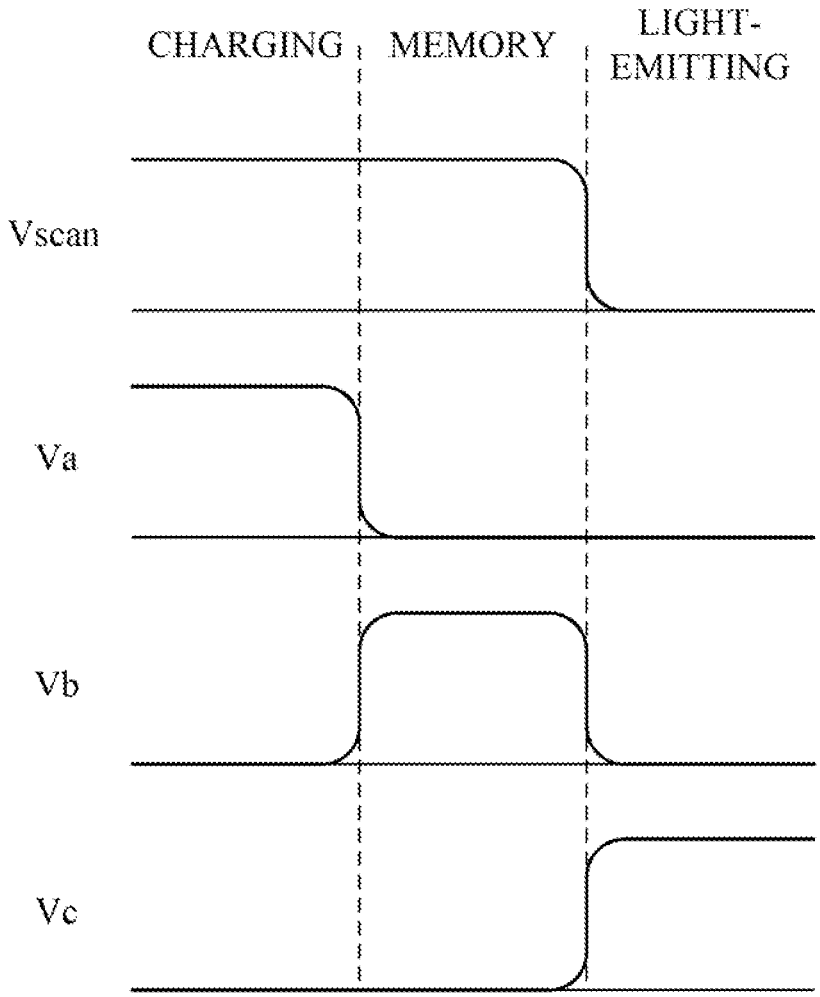
FIG. 3 is a timing diagram of the waveform of the scan signal Vscan, the charging switch control signal Va, the memory switch control signal Vb and the light-emitting switch control signal Vc in an embodiment of the present disclosure.

FIG. 3 is a timing diagram of the waveform of the scan signal Vscan, the charging switch control signal Va, the memory switch control signal Vb and the light-emitting switch control signal Vc in an embodiment of the present disclosure.

In a charging time period, the charging switch control signal Va controls the charging switch 206 to be conducted. At the same time, the memory switch control signal Vb and the light-emitting switch control signal Vc control the memory switch 208 and the three light-emitting switches 210, 212 and 214 to be un-conducted. Consequently, the scan signal Vscan turns on the switch transistor 200 to transmit the data signal Vdata from the first source/drain terminal of the switch transistor 200 to the second source/drain terminal of the switch transistor 200.

Figure 4A:
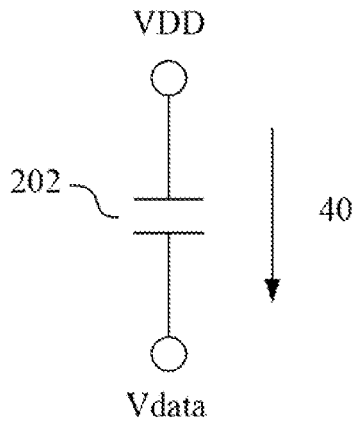
FIG. 4A is an equivalent circuit diagram of the pixel unit in the charging time period in an embodiment of the present disclosure.

FIG. 4A is an equivalent circuit diagram of the pixel unit 2 in the charging time period in an embodiment of the present disclosure. The equivalent circuit of the pixel unit 2 in the charging time period comprises the storage capacitor 202 connected to the first voltage end VDD and the data signal Vdata. In general, the voltage level of the first voltage end VDD is higher than the voltage level of the data signal Vdata. Hence, the current flows in the direction 40 from the first voltage end VDD to the storage capacitor 202 to charge the storage capacitor 202 according to the voltage difference between the first voltage end VDD and the data signal Vdata. The voltage Vcap across the two ends of the storage capacitor 202 is expressed by the following equation:

$$\mathrm{Vcap}=\mathrm{V}DD-\mathrm{Vdata} \quad \text{(Eq. 1)}$$

In the memory time period after the charging time period, the memory switch control signal Vb controls the memory switch 208 to be conducted, as shown in FIG. 3. The charging switch control signal Va and the light-emitting switch control signal Vc control the charging switch 206 and the three light-emitting switches 210, 212 and 214 to be un-conducted. The scan signal Vscan keeps turning on the switch transistor 200 to transmit the data signal Vdata from the first source/drain terminal of the switch transistor 200 to the second source/drain terminal of the switch transistor 200.

Figure 4B:
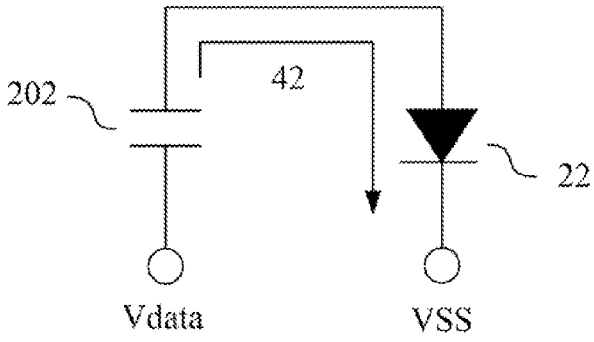
FIG. 4B is an equivalent circuit diagram of the pixel unit in the memory time period in an embodiment of the present disclosure.

FIG. 4B is an equivalent circuit diagram of the pixel unit 2 in the memory time period in an embodiment of the present disclosure. The equivalent circuit of the pixel unit 2 in the memory time period comprises the storage capacitor 202 and the OLED 22 connected together, in which the OLED 22 is connected to the first end of the storage capacitor 202. Therefore, the current flows in the direction 42 from the first end of the storage capacitor 202 to the second voltage end VSS through the OLED 22 to discharge the storage capacitor 202. The current keeps discharge the storage capacitor 202 until the voltage of the first end of the storage capacitor 202 is not able to make the OLED conducted. In other words, the discharging process stops when the voltage of the first end of the storage capacitor 202 decreases to a level equal to the threshold voltage Vth_o of the OLED 22. The voltage Vcap across the two ends of the storage capacitor 202 at the end of the memory time period is expressed by the following equation:

$$\mathrm{Vcap}=(\mathrm{V}th_o+\mathrm{V}ss)-\mathrm{Vdata} \quad \text{(Eq. 2)}$$

In the light-emitting time period after the memory time period, the light-emitting switch control signal Vc controls the three light-emitting switches 210, 212 and 214 to be conducted, as shown in FIG. 3. The charging switch control signal Va and the memory switch control signal Vb control the charging switch 206 and the memory switch 208 to be un-conducted. The scan signal Vscan thus turns off the switch transistor 202.

Figure 4C:
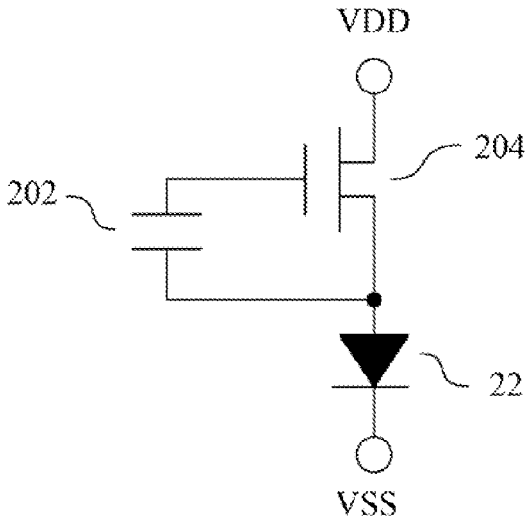
FIG. 4C is an equivalent circuit diagram of the pixel unit in the light-emitting time period in an embodiment of the present disclosure.

FIG. 4C is an equivalent circuit diagram of the pixel unit 2 in the light-emitting time period in an embodiment of the present disclosure. The equivalent circuit of the pixel unit 2 in the light-emitting time period comprises the storage capacitor 202, the driving transistor 204 and the OLED 22, in which the storage capacitor is connected between the gate terminal of the driving transistor and the second source/drain terminal of the driving transistor 204 and the first source/drain terminal of the driving transistor 204 is connected to the first voltage end VDD. The second source/drain terminal of the driving transistor 204 is further connected to the OLED 22. Therefore, when the voltage across the storage capacitor 202 is larger than the threshold voltage Vth_tft of the driving transistor 204, the voltage across the storage capacitor 202 serves as the turn-on voltage Von that makes the driving transistor 204 conducted. When the driving transistor 204 turns on in response to the voltage across the storage capacitor 202, a driving current I is provided from the driving transistor 204 to the OLED 22 through the first voltage end VDD. The driving current I is expressed by the following equation:

$$I=K(\mathrm{Von}-\mathrm{V}th_tft)^2=K(\mathrm{Vcap}-\mathrm{V}th_tft)^2$$

$$=K(((\mathrm{V}th_o+\mathrm{V}SS)-\mathrm{Vdata})-\mathrm{V}th_tft)^2 \quad \text{(Eq. 3)}$$

From the equation 3, it is known that the driving current I generated by the driving transistor 204 is varied according to the data signal Vdata and the threshold voltage Vth_o of the OLED 22. Therefore, when the threshold voltage Vth_o increases due to the material degradation of the OLED 22, the driving current I increases in response to compensate the decrease of the brightness of the OLED 22 that is caused by the deviation of the threshold voltage Vth_o.

Accordingly, the OLED driving circuit of the present disclosure can memorize the threshold voltage Vth_o of the OLED 22 in the memory time period such that the driving transistor 204 can generate the driving current I according to the data signal Vdata and the threshold voltage Vth_o of the OLED 22 in the light-emitting time period. The magnitude of the driving current I can thus be dynamically adjusted according to the threshold voltage Vth_o to compensate the decrease of the brightness of the OLED 22 that is caused by the deviation of the threshold voltage Vth_o.

Figure 5:
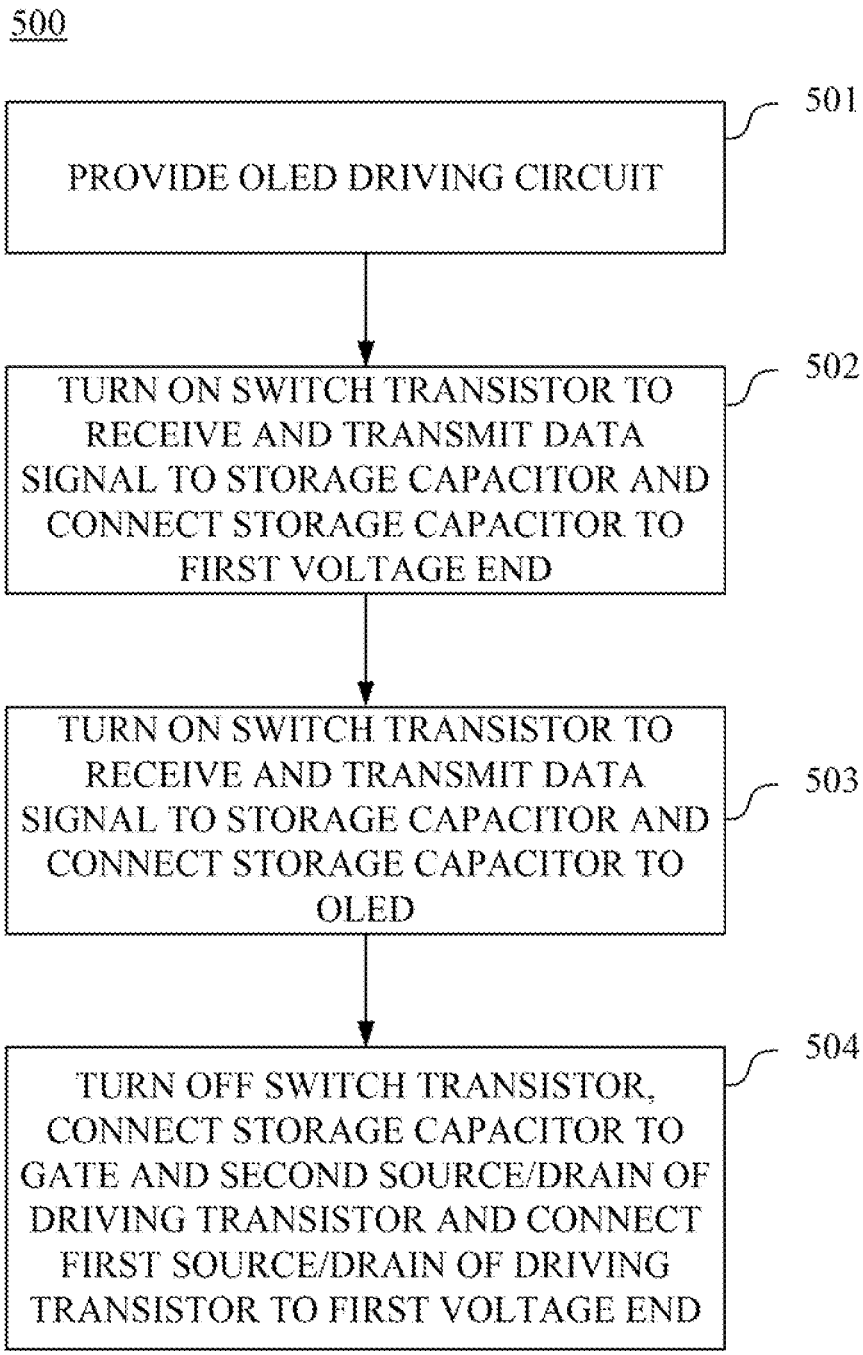
FIG. 5 is a flow chart of an OLED driving method in an embodiment of the present disclosure.

FIG. 5 is a flow chart of an OLED driving method 500 in an embodiment of the present disclosure. The OLED driving method 500 can be used with the OLED driving circuit 20 depicted in FIG. 2. The OLED driving method 500 comprises the steps outlined below. It is noted that the steps are not recited in the sequence in which the steps must be performed. That is, unless the sequence of the steps is expressly indicated, the sequence of the steps is interchangeable, and all or part of the steps may be simultaneously, partially simultaneously, or sequentially performed.

In step 501, the OLED driving circuit 20 as shown in FIG. 2 is provided.

In step 502, the switch transistor 200 is turned on during the charging time period to receive the data signal Vdata and transmit the data signal Vdata to the storage capacitor 202 and the storage capacitor 202 is controlled by the control module such that the storage capacitor 202 is connected to the first voltage end VDD. The storage capacitor 202 is thus charged according to the voltage difference between the first voltage end VDD and the data signal Vdata.

In step 503, the switch transistor 200 is turned on during the memory time period after the charging time period to receive the data signal Vdata and transmit the data signal Vdata to the storage capacitor 202 and the storage capacitor 202 is controlled by the control module such that the storage capacitor 202 is connected to the OLED 22. The storage capacitor 202 is thus discharged through the OLED 22.

In step 504, the switch transistor 200 is turned off during the light-emitting time period after the memory time period, the storage capacitor 202 is controlled by the control module such that the storage capacitor 202 is connected to the gate terminal of the driving transistor 204 and the second source/drain terminal of the driving transistor 204 and the first source/drain terminal of the driving transistor 204 is controlled to be connected to the first voltage end VDD. The driving transistor 204 is conducted according to the voltage across the storage capacitor 202 and provides the driving current to the OLED 22 according to the first voltage end VDD.

Accordingly, the OLED driving method of the present disclosure can dynamically adjust the magnitude of the driving current to compensate the decrease of the brightness of the OLED that is caused by the deviation of the threshold voltage of the OLED.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An OLED (organic light emitting diode) driving circuit to drive an OLED, wherein the OLED driving circuit comprises:

a switch transistor comprising;

a first source/drain terminal to receive a data signal;

a second source/drain terminal; and a gate terminal to receive a scan signal;

a storage capacitor comprising a first end and a second end;

a driving transistor comprising a first source/drain terminal, a gate terminal and a second source/drain terminal connected to the OLED; and a control module comprising:

a charging switch connected between the first end of the storage capacitor and a first voltage end;

a memory switch connected between the first end of the storage capacitor and the second source/drain terminal of the driving transistor; and three light-emitting switches respectively connected between the first end of the storage capacitor and the gate terminal of the driving transistor, between the first voltage end and the first source/drain terminal of the driving transistor and between the second end of the storage capacitor and the second source/drain terminal of the driving transistor;

wherein in a charging time period, the charging switch is controlled to be conducted and the three light-emitting switches and the memory switch are controlled to be un-conducted such that the scan signal turns on the switch transistor to transmit the data signal from the first source/drain terminal of the switch transistor to the second source/drain terminal of the switch transistor;

in a memory time period after the charging time period, the memory switch is controlled to be conducted and the three light-emitting switches and the charging switch are controlled to be un-conducted such that the scan signal turns on the switch transistor to transmit the data signal from the first source/drain terminal of the switch transistor to the second source/drain terminal of the switch transistor; and in a light-emitting time period after the memory time period, the three light-emitting switches are controlled to be conducted and the memory switch and the charging switch is controlled to be un-conducted such that the scan signal turns off the switch transistor.

2. The OLED driving circuit of claim 1, wherein the charging switch is controlled to be conducted or un-conducted according to a charging switch control signal, the three light-emitting switches are controlled to be conducted or un-conducted according to a light-emitting switch control signal and the memory switch is controlled to be conducted or un-conducted according to a memory switch control signal.

3. The OLED driving circuit of claim 2, wherein each of the charging switch, the three light-emitting switches and the memory switch is a transistor to receive the charging switch control signal, the light-emitting switch control signal or the memory switch control signal by a gate of the transistor.

4. The OLED driving circuit of claim 1, wherein the first source/drain terminal of the switch transistor is connected to a data line to receive the data signal from the data line.

5. The OLED driving circuit of claim 1, wherein the gate terminal of the switch transistor is connected to a scan line to receive the scan signal from the scan line.

6. The OLED driving circuit of claim 1, wherein the storage capacitor is charged according to a voltage difference between the first voltage end and the data signal during the charging time period, the storage capacitor is discharged through the OLED during the memory time period and the driving transistor turns on in response to a voltage across the storage capacitor and provides a driving current to the OLED through the first voltage end during the light-emitting time period.

7. The OLED driving circuit of claim 1, wherein an anode of the OLED is connected to the second source/drain terminal of the driving transistor and a cathode of the OLED is connected to a second voltage end.

8. The OLED driving circuit of claim 7, wherein a second voltage level of the second voltage end is smaller than a first voltage level of the first voltage end.

9. A display panel comprising:

a data driving module comprising a plurality of data lines;

a gate driving module comprising a plurality of scan lines; and a pixel array comprising a plurality of pixel units each comprising:

an OLED; and an OLED driving circuit comprising:

a switch transistor comprising;

a first source/drain terminal to receive a data signal from one of the data lines;

a second source/drain terminal; and a gate terminal to receive a scan signal from one of the scan lines;

a storage capacitor comprising a first end and a second end;

a driving transistor comprising a first source/drain terminal, a gate terminal and a second source/drain terminal connected to the OLED; and a control module comprising:

a charging switch connected between the first end of the storage capacitor and a first voltage end;

a memory switch connected between the first end of the storage capacitor and the second source/drain terminal of the driving transistor; and three light-emitting switches respectively connected between the first end of the storage capacitor and the gate terminal of the driving transistor, between the first voltage end and the first source/drain terminal of the driving transistor and between the second end of the storage capacitor and the second source/drain terminal of the driving transistor;

wherein in a charging time period, the charging switch is controlled to be conducted and the three light-emitting switches and the memory switch are controlled to be un-conducted such that the scan signal turns on the switch transistor to transmit the data signal from the first source/drain terminal of the switch transistor to the second source/drain terminal of the switch transistor;

in a memory time period after the charging time period, the memory switch is controlled to be conducted and the three light-emitting switches and the charging switch are controlled to be un-conducted such that the scan signal turns on the switch transistor to transmit the data signal from the first source/drain terminal of the switch transistor to the second source/drain terminal of the switch transistor; and in a light-emitting time period after the memory time period, the three light-emitting switches are controlled to be conducted and the memory switch and the charging switch are controlled to be un-conducted such that the scan signal turns off the switch transistor.

10. The display panel of claim 9, wherein the charging switch is controlled to be conducted or un-conducted according to a charging switch control signal, the three light-emitting switches are controlled to be conducted or un-conducted according to a light-emitting switch control signal and the memory switch is controlled to be conducted or un-conducted according to a memory switch control signal.

11. The display panel of claim 10, wherein each of the charging switch, the three light-emitting switches and the memory switch is a transistor to receive the charging switch control signal, the light-emitting switch control signal or the memory switch control signal by a gate of the transistor.

12. The display panel of claim 9, wherein the storage capacitor is charged according to a voltage difference between the first voltage end and the data signal during the charging time period, the storage capacitor is discharged through the OLED during the memory time period and the driving transistor turns on in response to a voltage across the storage capacitor and provides a driving current to the OLED through the first voltage end during the light-emitting time period.

13. The display panel of claim 9, wherein an anode of the OLED is connected to the second source/drain terminal of the driving transistor and a cathode of the OLED is connected to a second voltage end.

14. The display panel of claim 13, wherein a second voltage level of the second voltage end is smaller than a first voltage level of the first voltage end.

15. An OLED driving method to drive an OLED, wherein the OLED driving method comprises:

providing an OLED driving circuit comprising a switch transistor, a driving transistor, a storage capacitor, and a control module, wherein the storage capacitor is connected to the switch transistor and a second source/drain terminal of the driving transistor is connected to the OLED;

turning the switch transistor on during a charging time period to receive a data signal and transmit the data signal to the storage capacitor and controlling the storage capacitor by the control module such that the storage capacitor is connected to a first voltage end;

turning the switch transistor on during a memory time period after the charging time period to receive the data signal and transmit the data signal to the storage capacitor and controlling the storage capacitor by the control module such that the storage capacitor is connected to the OLED; and turning the switch transistor off during a light-emitting time period after the memory time period, controlling the storage capacitor by the control module such that the storage capacitor is connected to a gate terminal of the driving transistor and the second source/drain terminal of the driving transistor and controlling a first source/drain terminal of the driving transistor to be connected to the first voltage end.

16. The OLED driving method of claim 15, wherein in the charging time period further comprising charging the storage capacitor according to a voltage difference between the first voltage end and the data signal.

17. The OLED driving method of claim 15, wherein in the memory time period further comprising discharging the storage capacitor through the OLED.

18. The OLED driving method of claim 15, wherein in the light-emitting time period further comprising turning on the driving transistor in response to a voltage across the storage capacitor and providing a driving current to the OLED through the first voltage end.

* * * * *